US006923322B2

(12) United States Patent
Lenker

(10) Patent No.: US 6,923,322 B2
(45) Date of Patent: Aug. 2, 2005

(54) SPORTS CAP CONTAINER

(76) Inventor: Kenneth I. Lenker, 2062 County Line Rd, East Greenville, PA (US) 18041-9739

( * ) Notice: Subject to any disclaimer, the term of this patent is extended or adjusted under 35 U.S.C. 154(b) by 21 days.

(21) Appl. No.: 10/210,964

(22) Filed: Aug. 2, 2002

(65) Prior Publication Data

US 2004/0020816 A1 Feb. 5, 2004

(51) Int. Cl.[7] ..... B65D 85/00
(52) U.S. Cl. ..... 206/457; D9/320
(58) Field of Search ..... D2/866; D9/320, D9/457; D6/512, 552; D11/149, 157; 2/209.12–209.14; 40/312; 206/8, 216, 457, 458; 220/796, 801

(56) References Cited

U.S. PATENT DOCUMENTS 1,782,414 A * 11/1930 Duer ..... 190/6
2,606,708 A * 8/1952 Irvan ..... 220/796
4,881,654 A * 11/1989 Stazo et al. ..... 2/209.13
D333,375 S * 2/1993 Ouellette ..... D2/866
D367,156 S * 2/1996 Dunlavey ..... D2/866
5,813,546 A * 9/1998 Wilson et al. ..... 211/32
5,865,013 A * 2/1999 Jackson ..... 53/474
D412,611 S * 8/1999 Simpson ..... D2/891

* cited by examiner

*Primary Examiner*—Jim Foster
(74) *Attorney, Agent, or Firm*—Armand M. Vozzo, Jr.

(57) ABSTRACT

A novelty storage device is disclosed for holding personal items in a form simulative of a baseball-style cap comprising a cap member formed having a crown portion transversely sectioned to provide an open back and a support panel fitted and secured to the open back of the crown portion. The present device further comprises a container member having a rectangular receptacle and a separate ledge panel formed upwardly and disposed forwardly of the receptacle to provide a channel therebetween for releasable engagement of the support panel and assembly of the container member to the cap member. The container member may be modified in its form to provide the receptacle in a variety of configurations and may be further provided with a lid as closure for the receptacle. In the preferred embodiment, the cap member is provided with a front bill relative to the sectioned crown portion but may be alternatively formed without the bill and made simulative of the back of the baseball-style cap.

7 Claims, 4 Drawing Sheets

SPORTS CAP CONTAINER

BACKGROUND OF THE INVENTION

The present invention relates to containers used to store personal items at home or in the workplace, and more particularly to a sports cap container device for storing items in a form simulative of a baseball-type cap wherein a cap member having a transversely sectioned crown is fitted with a support panel and adapted to engage a container member along the sectioned crown so that the cap and container members may be held together in a displayable assembly.

In the household and at places of work, storage containers of various shapes and sizes are employed to hold an assortment of personal items for ready access and availability. The structure and configuration of these storage containers generally conform to the size and shape of the particular items intended to be held therein. Many are constructed to stand alone on a table, shelf or other horizontal platform, while others of these storage containers may be adapted for mounting on a wall or other vertical surface that is easily accessible to the user.

While such storage containers for personal items can be found in virtually every home and office and are often designed and made to be decorative, there are none known to incorporate into their physical structure the popular features of a sports cap to store items in a distinctive and attractive device capable of being displayed and collected. Such a device that combines the features of a sports cap with the structural form of a container would not only be a useful storage device but also serve to promote a sports team or other organization personally favored by an individual.

SUMMARY OF THE INVENTION

Accordingly, it is a general purpose and object of the present invention to provide a novelty device for storing personal items at home or in the workplace that is simulative of a baseball-type cap.

Another object of the present invention is to provide a novel storage device for personal items that incorporates actual features of a sports cap for decorative display in the home or office.

Still another object of the present invention is to provide a personal storage device that simulates the features of a baseball-type cap in an attractive unit that can be easily assembled and altered, if necessary, to accommodate different caps and various stored items.

A still further object of the present invention is to provide a sports cap container device for personal use that is reasonably inexpensive to fabricate and adaptable in its assembly to accommodate the storage needs and personal interests of the user.

Briefly, these and other objects of the present invention are accomplished by a novelty storage device for holding personal items in a form simulative of a baseball-style cap comprising a cap member formed having a crown portion transversely sectioned to provide an open back and a support panel fitted and secured to the open back of the crown portion. The present device further comprises a container member having a rectangular receptacle and a separate ledge panel formed upwardly and disposed forwardly of the receptacle to provide a channel therebetween for releasable engagement of the support panel and assembly of the container member to the cap member. The container member may be modified in its form to provide the receptacle in a variety of configurations and may be further provided with a lid as closure for the receptacle. In the preferred embodiment, the cap member is provided with a front bill relative to the sectioned crown portion but may be alternatively formed without the bill and made simulative of the back of the baseball-style cap.

For a better understanding of these and other aspects of the present invention, reference should be made to the following detailed description taken in conjunction with the accompanying drawings in which like reference numerals and characters designate like parts throughout the figures thereof.

BRIEF DESCRIPTION OF THE DRAWINGS

For a fuller understanding of the nature and objects of the present invention, referenced in the detailed description set forth below shall be made to the accompanying drawings in which.

DETAILED DESCRIPTION OF THE INVENTION

Figure 1:
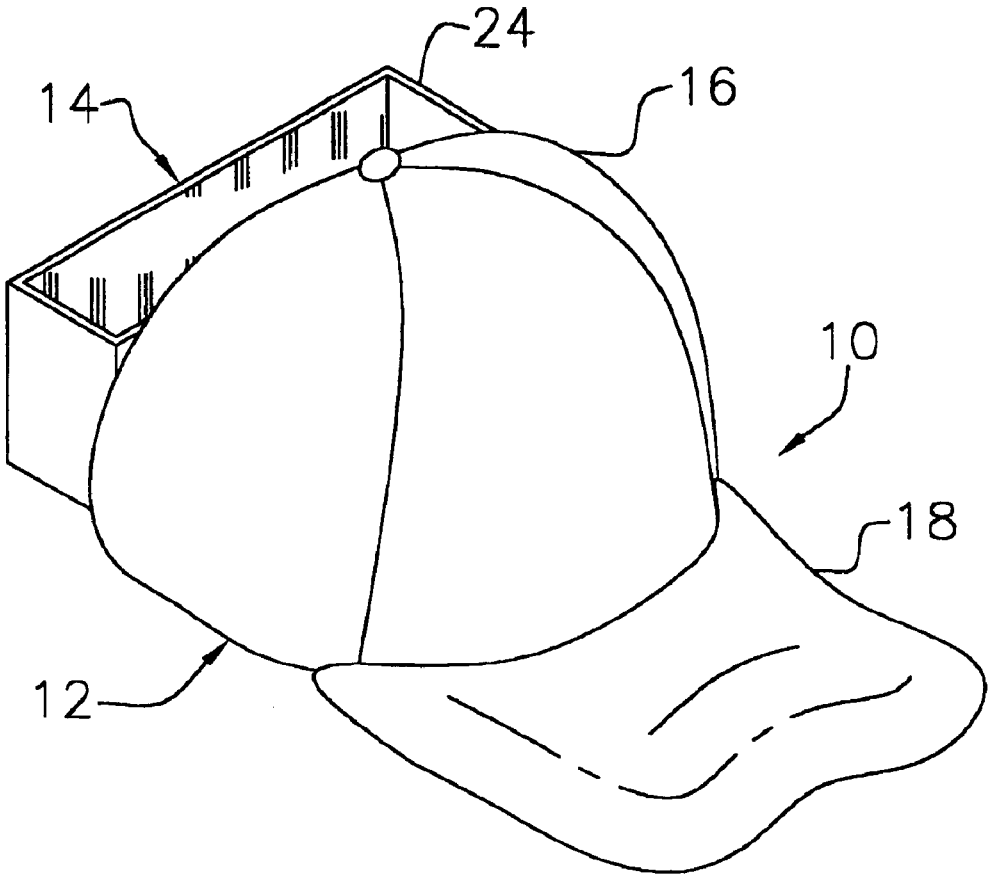
FIG. 1 is a front perspective view of a storage device according to the present invention.

Referring now to the drawings and particularly at first to FIG. 1, a storage device 10 according to the present invention is shown comprising a cap member 12 and a container member 14 assembled thereto. The cap member 12 is made in a resultant form simulative of a traditional baseball-style cap but having a sectioned crown portion 16 with a bill 18 that is attached to the crown portion and made to extend forwardly therefrom. As seen more clearly in FIG. 4, the sectioned crown portion 16 of cap member 12 comprises a transverse section approximately one-half the size of the standard crown of a traditional baseball-style cap, the crown portion of the present storage device 10 in its preferred embodiment being the front half of the standard crown with an open back end. A support panel 20, described in greater detail below, is formed to fit the open back end of the crown portion 16 and is secured thereto in a substantially vertical position. Container member 14 includes in large part a receptacle body 24 that is substantially rectangular in its preferred form. The receptacle body 24, seen more clearly in FIG. 6, may be varied in its size and shape in order to hold various items within its chamber, and preferably is formed having a substantially flat and vertically upright front wall intended to face the back end of the cap member 12 and facilitate the engagement of the container member 14 with support panel 20, as described in greater detail below.

Figure 2:
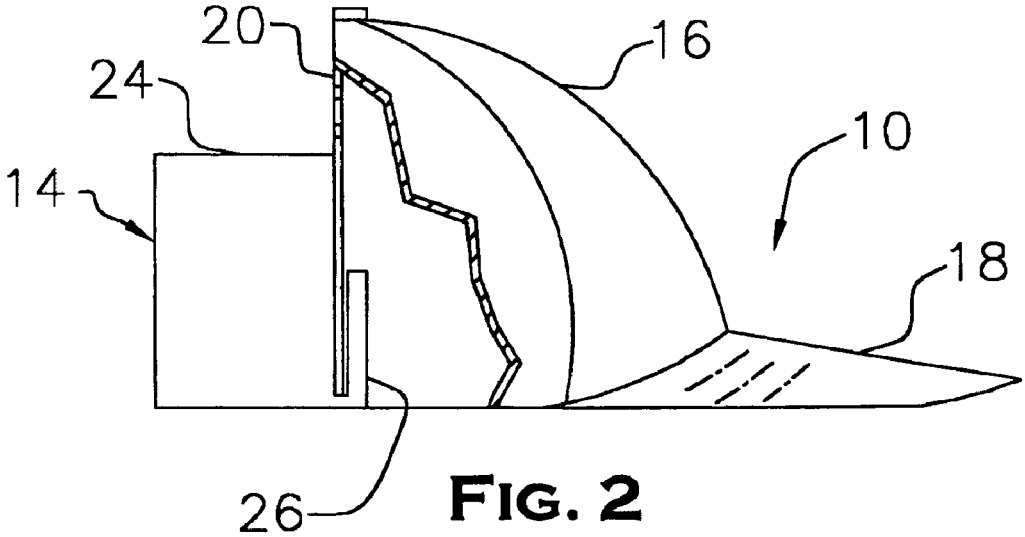
FIG. 2 is a side elevation view of the storage device of FIG. 1 shown with a portion of the external structure broken away.
Figure 6:
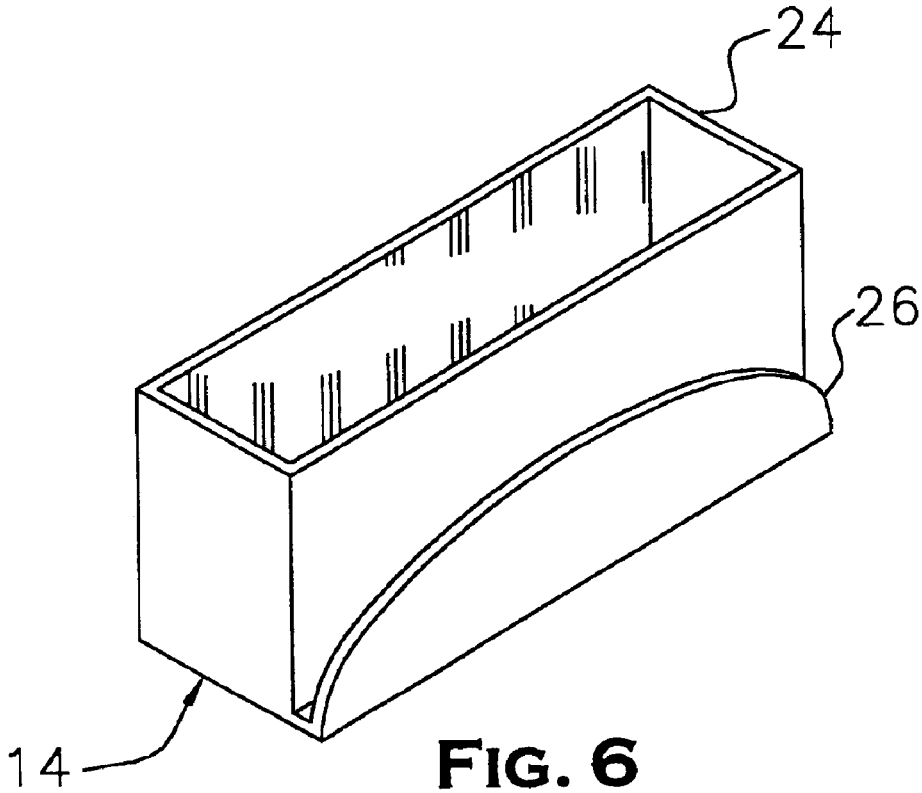
FIG. 6 is a front perspective view of the container member of the present storage device.

Referring now to FIGS. 2 and 6 in conjunction with FIG. 1, the container member 14 is further provided with and formed having a ledge panel 26 that is spaced apart from the front wall of the receptacle body 24 and disposed substantially parallel thereto. As best seen in FIG. 6, the ledge panel 26 is a planar member projecting upward from the bottom of the container member 14 just forward of the front wall of the receptacle body 24 to provide an intermediate space or channel between the ledge panel and the front of the receptacle body. The width of the intermediate channel provided between the ledge panel 26 and receptacle body 24 is sized to fit and engage the support panel 20 on the back end of the crown portion 16 when the cap member 12 is assembled to the container member 14, as shown in FIG. 2. The ledge panel 26 may be integrally formed and fixed in connection with the receptacle body 24, as shown in the drawing figures, or may be separately fabricated and attached in proper position along the bottom front edge of the receptacle body of container member 14. The ledge panel 26 projects upward to a height typically below the top of the receptacle body 24 and is preferably formed having a curved configuration, as shown in FIG. 6, intended to conform with the curvature of the back end of the crown section 16 and its support panel 20.

Figure 3:
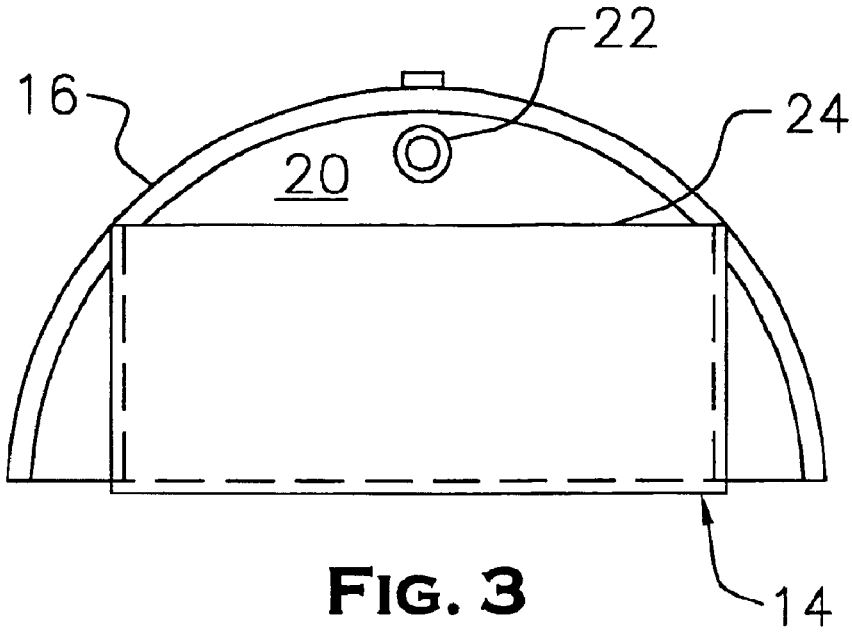
FIG. 3 is a rear elevation view of the storage device shown in FIG. 1.
Figure 4:
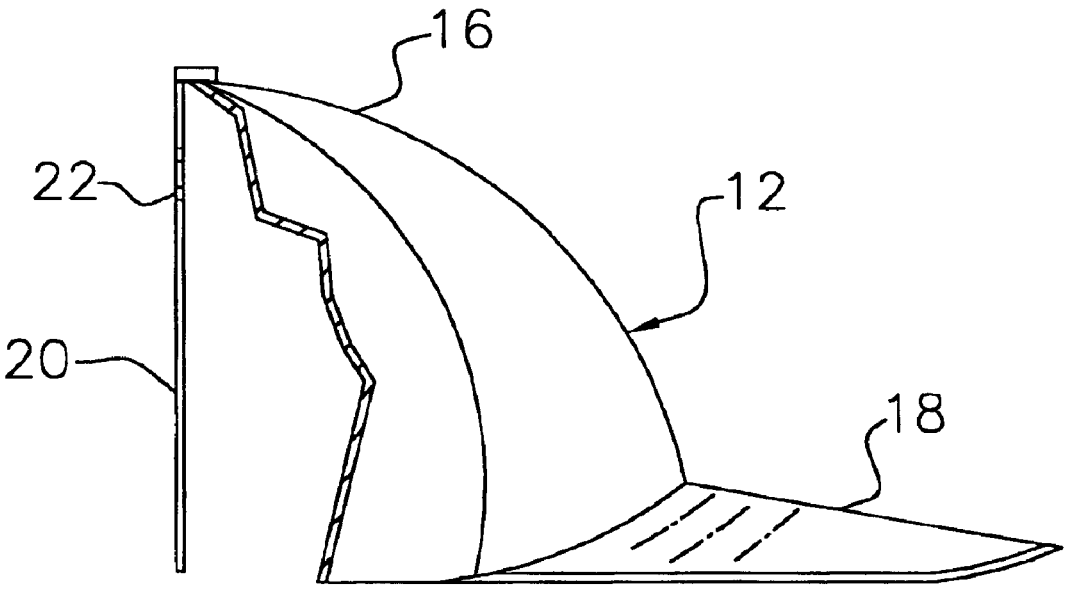
FIG. 4 is a side elevation view of the cap member of the present storage device.
Figure 5:
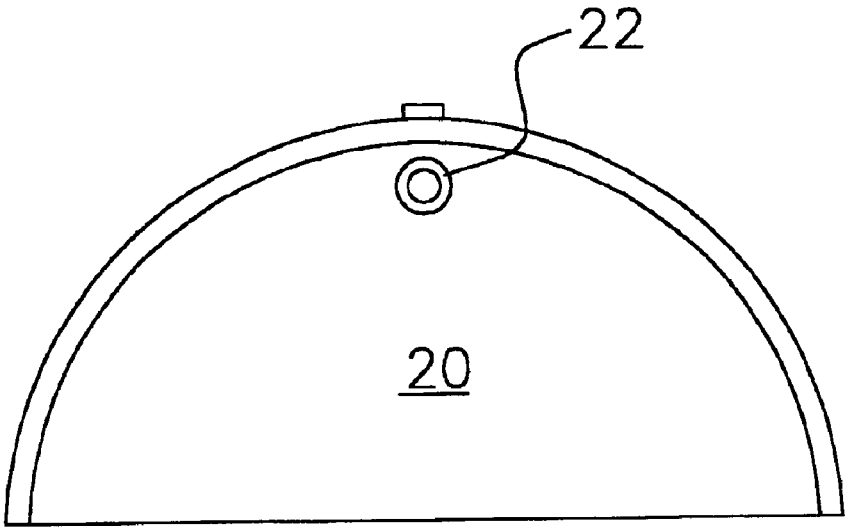
FIG. 5 is a rear elevation view of the cap member shown in FIG. 4.

Referring now to FIGS. 3–5, the support panel 20 is a relatively thin and rigid planar member that is formed having a substantially semi-circular or similarly curved configuration that conforms with the open back end of the crown portion 16. Secured around its perimeter to the outer edge of the crown portion 16 by conventional means, the support panel 20 is disposed firmly in a substantially vertical position upon the back end of the crown portion. In this secure position, the support panel 20 essentially covers the open back end of the crown portion 16 and holds the combined elements of the cap member 12 together for engagement and assembly with the container member 14. An eyelet 22 inserted into the support panel 20 near the top and center of its planar surface is provided in order to hang the cap member 12 when disassembled and separated from the container member 14.

The described cap member 12, as shown particularly in FIGS. 1–5, may be reconstructed from a standard baseball-style cap by cutting away and removing the back portion of its crown, binding the remaining back edge of the crown, as necessary, and securing the support panel 20 onto the open back end of the resulting crown portion 16. Alternatively, the cap member 12 may be fabricated from different fabric materials in assorted sizes and on a variety of scales using conventional means and techniques for cap making. It should be further understood that the described cap member 12 together with its associated support panel 20 may also be integrally formed in a more rigid configuration from a plastic material using standard molding means and related manufacturing techniques. The container member 14 may also be integrally formed from a plastic material and combined in its structural elements with that of cap member 12, similarly formed in plastic, to produce a unitized storage device 10 in accordance with the present invention.

Figure 7:
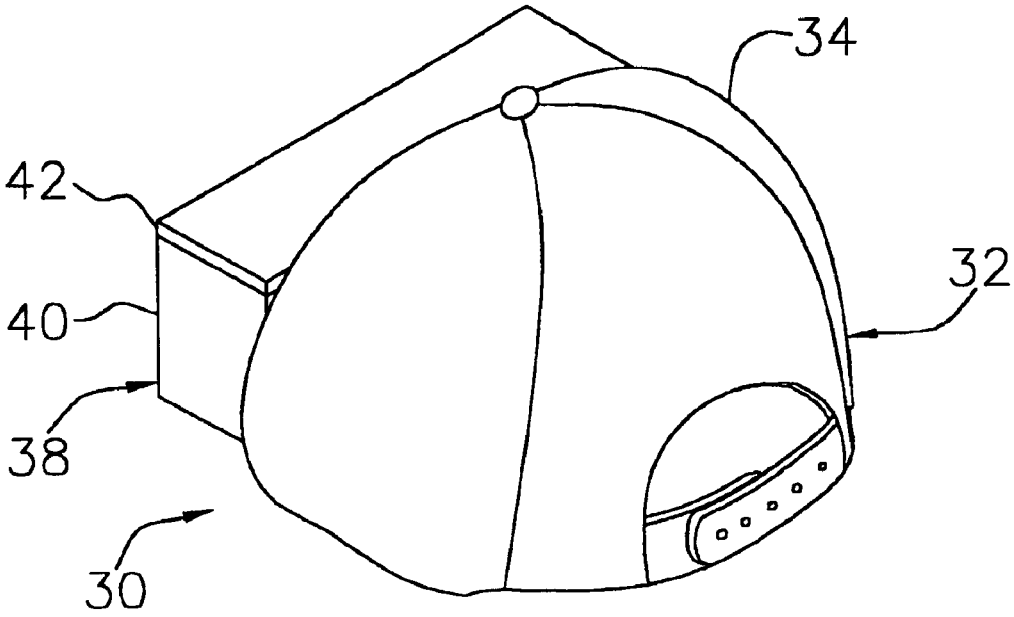
FIG. 7 is a front perspective view of an alternate embodiment of the storage device in accordance with the present invention.
Figure 8:
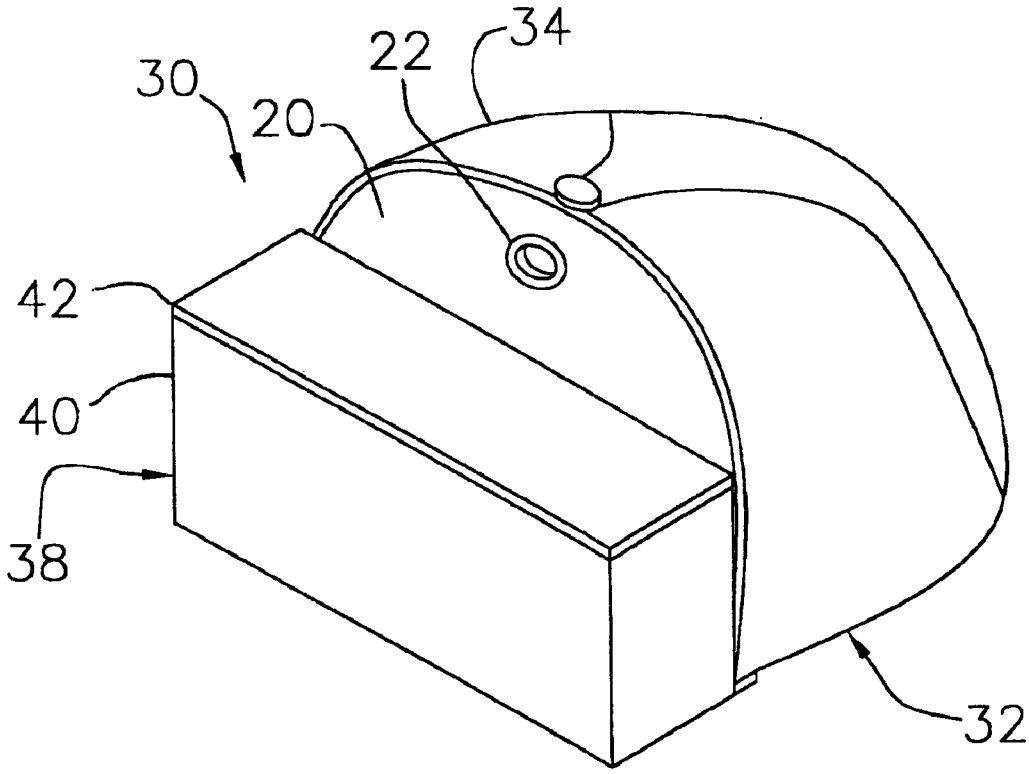
FIG. 8 is a rear perspective view of the alternate embodiment of the storage device shown in FIG. 7.

Referring now to FIGS. 7 and 8, there is shown an alternate embodiment of the present storage device, generally designated 30, having a cap member 32 and a container member 38 assembled together in modified forms each different from the respective cap member 12 and container member 14 described above and shown in FIGS. 1–6. This alternate version of storage device 30 includes cap member 32 that is simulative of the back portion of a standard baseball-style cap having a crown portion 34 sectioned transversely, as in the case of crown portion 16, but done so in reverse form. As in the preferred embodiment described above, storage device 30 further includes support panel 20 formed to fit and cover the open end of the crown portion 34 and be secured thereto in a substantially vertical position. An eyelet 22 may be similarly provided and inserted within the present support panel 20 to allow the cap member 32 to hang separately from the container member 38 of the present storage device 30.

The container member 38 of the alternate storage device 30 is constructed and formed similarly to the container member 14 included in the preferred embodiment but having a lid 42 additionally provided to close a rectangular receptacle body 40 that is otherwise the same as in the aforedescribed container member shown in FIG. 6. The lid 42 is formed to fit and cover the top of the receptacle body 40 and may be separate from or hinged to the receptacle in order to close its chamber when desired. While not shown particularly in FIGS. 7 and 8, the container member 38 is formed having a ledge panel 26 disposed forwardly of receptacle body 40, just as described above and shown in FIGS. 2 and 6, to provide an engagement channel for insertion of the support panel 20 mounted on the modified cap member 32. Accordingly, the engagement and releasable assembly of the modified cap member 32 and container member 38 in the alternate embodiment of storage device 30 is similar in means and manner as in the case of the aforedescribed storage device 10 shown in FIGS. 1–6.

Therefore, it is apparent that the described invention provides a novel device that is useful for storing personal items at home or in the workplace and attractive in form simulative of a baseball-style cap. The disclosed storage device provides a useful means for storing personal items that incorporates actual features of a sports cap for display in the home or office. The present invention further provides a personal storage device that presents an attractive product simulative of a baseball-style cap that can be easily assembled and modified, if necessary, to accommodate different caps and various stored items. In addition, the disclosed invention provides a personal storage device made in the form of a sports cap that is reasonably inexpensive to fabricate and assemble and further adaptable in its assembled members to accommodate an assortment of items and interests of the user.

Obviously, other embodiments and modifications of the present invention, in addition to those described herein, will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiments are therefore considered to be part of the present invention. For example, the cap member with its sectioned crown may be made from or constructed in a form simulative of any dome-shaped cap with or without a brim, such as a beanie cap or the like, and be in accordance with the intended scope of the present invention. Accordingly, it is understood that this invention is not limited to the particular embodiments described, but rather is intended to cover modifications within the spirit and scope of the present invention as expressed in the appended claims.

What is claimed:

1. A storage device, comprising:

a container member formed having a receptacle adapted to hold an item and a ledge panel disposed apart from the receptacle to provide a channel therebetween; and a cap member simulative of a baseball-style cap with a bill and releasably assembled to said container member, said cap member including a transversely sectioned crown with an open back end formed thereacross and a support panel fitted to conform with the open back end of the sectioned crown and attached thereto, the support panel being substantially flat for engagement with the channel.

2. A storage device according to claim 1, wherein said container member further comprises:

a lid adapted to engage and formed to cover the receptacle.

3. A storage device according to claim 2, wherein the receptacle is rectangular in configuration.

4. A storage device, comprising:

a cap portion having a transversely sectioned crown with a forward bill and a back end formed thereacross;

a support panel made substantially flat and integrally formed within the back end of the sectioned crown; and a container portion formed having a receptacle body adapted to hold an item and removably affixed to the bottom edge of the support panel.

5. A storage device according to claim 4, wherein said cap portion is simulative of a baseball-style cap.

6. A storage device according to claim 4, further comprising:

a lid adapted to engage said container portion and formed to cover the receptacle body.

7. A storage device according to claim 6, wherein the receptacle body is formed having a rectangular configuration.

* * * * *